US008056849B2

(12) United States Patent
Ng et al.

(10) Patent No.: US 8,056,849 B2
(45) Date of Patent: Nov. 15, 2011

(54) BRAKING MECHANISM AND TAPE CARTRIDGE FOR TAPE MEASURE

(75) Inventors: Gavin K F Ng, Sha Tin (HK); Edward John Huxley, Co Durham (GB)

(73) Assignee: Black & Decker Inc., Towson, MD (US)

( * ) Notice: Subject to any disclaimer, the term of this patent is extended or adjusted under 35 U.S.C. 154(b) by 981 days.

(21) Appl. No.: 11/355,421

(22) Filed: Feb. 16, 2006

(65) Prior Publication Data

US 2007/0187542 A1 Aug. 16, 2007

(51) Int. Cl.
*B65H 75/48* (2006.01)

(52) U.S. Cl. ..... 242/378.2; 242/396.5; 33/767

(58) Field of Classification Search ..... 242/381.5, 242/396, 396.1, 396.2, 396.5, 396.6, 378, 242/378.1, 378.2, 379, 379.2; 33/767, 761, 33/769, 755, 764; 192/105 BA, 103 B; 188/180, 188/184, 185, 188, 135, 166, 114
See application file for complete search history.

(56) References Cited

U.S. PATENT DOCUMENTS 1,515,985 A * 11/1924 Wright ..... 188/185
2,904,282 A * 9/1959 Zelnick ..... 242/381.5
3,026,980 A * 3/1962 Hoff ..... 192/105 BA
3,687,254 A * 8/1972 Bystrom ..... 192/105 A
3,696,901 A * 10/1972 Henry ..... 192/105 BA
3,889,897 A * 6/1975 Van Zelderen ..... 242/381.5
3,922,790 A 12/1975 Quenot
4,200,983 A * 5/1980 West et al. ..... 33/767
4,907,756 A * 3/1990 Bourrat ..... 242/381.5
5,509,616 A * 4/1996 Millen et al. ..... 242/381.5
5,515,617 A * 5/1996 Canfield ..... 33/768
5,603,397 A * 2/1997 Meyers ..... 192/105 BA
5,967,443 A * 10/1999 Green ..... 242/381.5
6,098,299 A 8/2000 Collins et al.
7,260,899 B2 * 8/2007 Jones ..... 33/760
2002/0059735 A1 * 5/2002 Ponce ..... 33/760
2004/0118002 A1 * 6/2004 Lu ..... 33/767
2007/0152091 A1 * 7/2007 Campbell ..... 242/371
2007/0186433 A1 * 8/2007 Campbell ..... 33/767

* cited by examiner

*Primary Examiner* — William A Rivera
*Assistant Examiner* — Juan Campos, Jr.
(74) *Attorney, Agent, or Firm* — Shook, Hardy & Bacon L.L.P.

(57) ABSTRACT

The invention relates to a braking mechanism and tape cartridge for a tape measure. In accordance with one aspect of the invention, the tape measure includes a housing, a fixed cylindrical surface located in the housing, a reel supported in the housing for rotation, and at least one braking mechanism located on the reel. The braking mechanism includes a flyweight, a spring, and a rail. The spring and rail allow the flyweight to move between a first position, in which the flyweight is not in contact with the fixed cylindrical surface, and a second position, in which the flyweight is in contact with the fixed cylindrical surface. In another aspect, a tape cartridge is provided that includes two sidewalls and a cylindrical wall, which define a container. The tape cartridge is adapted to support a tape assembly therein, and may be mounted in the tape measure housing.

28 Claims, 7 Drawing Sheets

BRAKING MECHANISM AND TAPE CARTRIDGE FOR TAPE MEASURE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates generally to tape measures. More specifically, the present invention also relates to an automatic braking mechanism for slowing the speed of retraction of a tape for a tape measure. In addition, the present invention relates to a cartridge for containing a tape assembly within the tape measure.

BACKGROUND OF THE INVENTION

Tape measures often employ spring-loaded means for returning an extended measuring tape to a coiled position within the housing of the tape measure. Such tape measures generally include a spring connected to a reel on one end and to a stationary pin on the other end. The stationary pin is rigidly connected to a non-rotating housing, which contains the reel. One end of the tape is connected to the hub of the reel and the rest of the tape is coiled around the reel. When the tape is pulled out of the tape measure housing, the reel is force to rotate against the force of the spring. As the tape is pulled out of the housing and the reel is rotated, the force of the spring increases so that when the hook end of the tape is released, the tape will rapidly retract back into its fully coiled position.

Current spring-loaded type tape measures present a number of drawbacks. First, the speed of the retracting tape can be quite high, especially when the tape is allowed to retract from a fully extended position. The rapidly coiling tape can buckle within the tape measure housing. In addition, the hook end of the tape may impact the housing inlet with a force that causes damage to tape measure components, including the housing, the reel, the hook end of the tape, and the tape itself. The rapidly coiling tape can also be dangerous to operator's fingers.

A second drawback of current spring-loaded type tape measures is that as a component, such as the reel, tape, or spring, is damaged or worn over time, it must be replaced. However, replacement of a component can be cumbersome. For example, replacement of a damaged tape requires opening the housing, removing the reel, unwinding the old tape, attaching a new tape, carefully coiling the new tape, and replacing the reel in the tape housing.

Accordingly, what is needed is an automatic braking mechanism for slowing the retraction of a reel within a tape measure without interfering with the extension of the tape. Additionally, it would be desirable to provide a tape measure in which damaged or worn components may be easily replaced.

SUMMARY OF THE INVENTION

In some embodiments, the present invention is directed to a braking mechanism and tape cartridge for a tape measure. Thus, in one aspect, an embodiment of the present invention relates to a tape measure with a braking mechanism. The tape measure includes a housing, a fixed cylindrical surface, a reel, and at least one braking mechanism. The housing is a container with an opening and is configured to hold the reel. The reel has a tape that may extend and retract from the opening in the housing. A fixed cylindrical surface is also located in the housing. The braking mechanism is located on the reel and includes a flyweight, at least one spring, and at least one rail. The flyweight has a first and second end. The spring is connected between the reel and the first end of the flyweight and allows the flyweight to move between a first position and a second position based on a centrifugal force on the flyweight caused by rotation of the reel. In the first position, the second end of the flyweight is not in contact with the fixed cylindrical surface. In the second position, the second end of the flyweight is in contact with the fixed cylindrical surface, causing fictional drag and slowing the rotation of the reel. The rail maintains the flyweight in contact with the reel, while allowing the flyweight to move between the first position and the second position.

In another aspect, an embodiment of the invention is a tape cartridge for a tape measure. The tape cartridge includes a first sidewall, a second sidewall, and a cylindrical wall, which define a container. The tape cartridge is adapted to support a tape assembly within the container. The tape cartridge generally includes a reel that has a tape adapted to extend and retract from an opening in the cylindrical wall. The tape cartridge may be mounted in a housing of the tape measure.

BRIEF DESCRIPTION OF THE DRAWINGS

The present invention is described below in more detail with reference to the attached drawing figures, in which like reference numerals denote the elements, wherein.

DETAILED DESCRIPTION OF THE INVENTION

Figure 1:
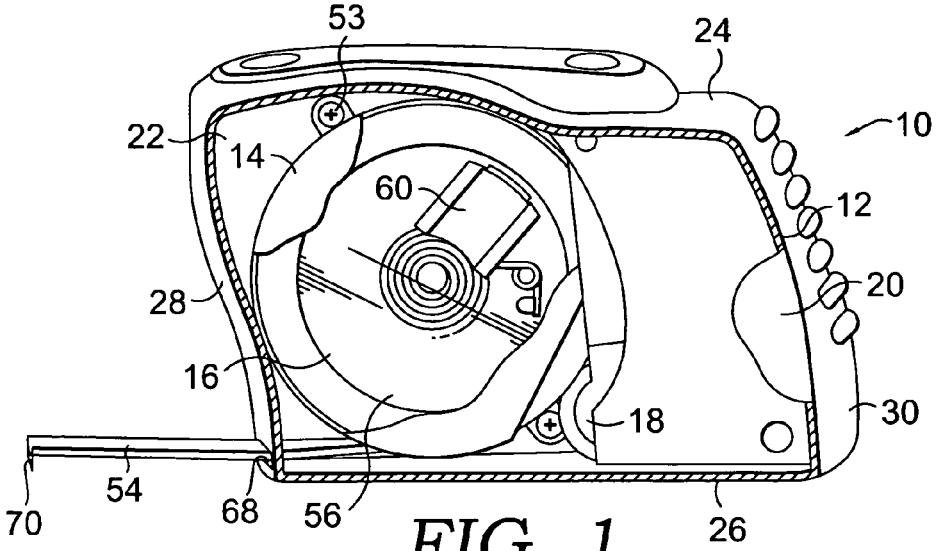
FIG. 1 is a sectional side elevational view of a tape measure in accordance with an embodiment of the present invention with a portion of a cassette cut away for clarity.

With initial reference to FIG. 1, an automatic tape measure according to an embodiment of the present invention is designated generally with the reference numeral 10. While an automatic tape measure is shown, it will be appreciated by one of ordinary skill in the art that a conventional manual tape measure may be used. The tape measure 10 generally includes a housing 12, a cartridge 14, a tape assembly 16, and a drive 18. The housing 12 generally includes a pair of sidewalls 20, 22, top and bottom walls 24, 26, a front wall 28, and a rear wall 30. The housing 12 is generally an integrated unit constructed from molded plastic, however, any suitable material may be used. The housing 12 is configured to define a container, which houses the cartridge 14, the tape assembly 16, and the drive 18.

Figure 2:
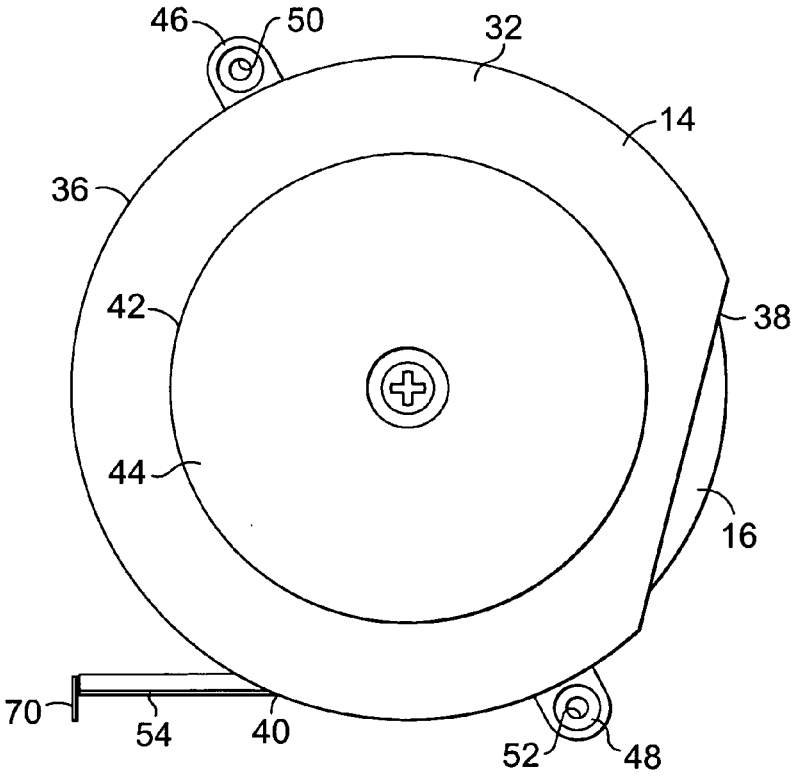
FIG. 2 is a side elevational view of a cassette or tape cartridge in accordance with an embodiment of the present invention.
Figure 3:
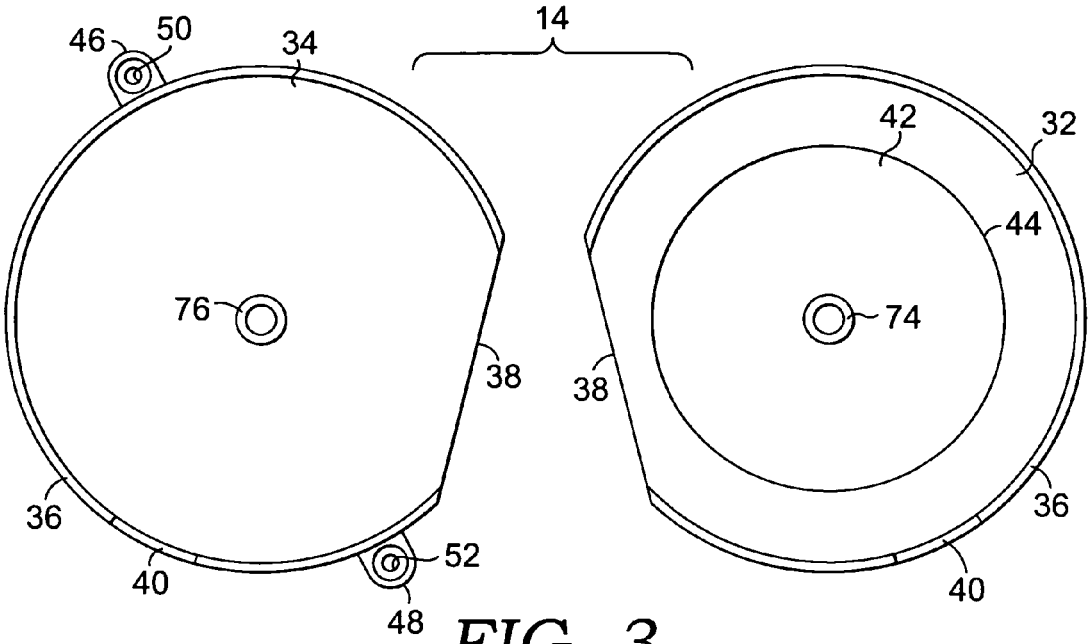
FIG. 3 is an exploded side elevational view of the tape cartridge opened in clam shell fashion showing the inside of the tape cartridge.
Figure 4:
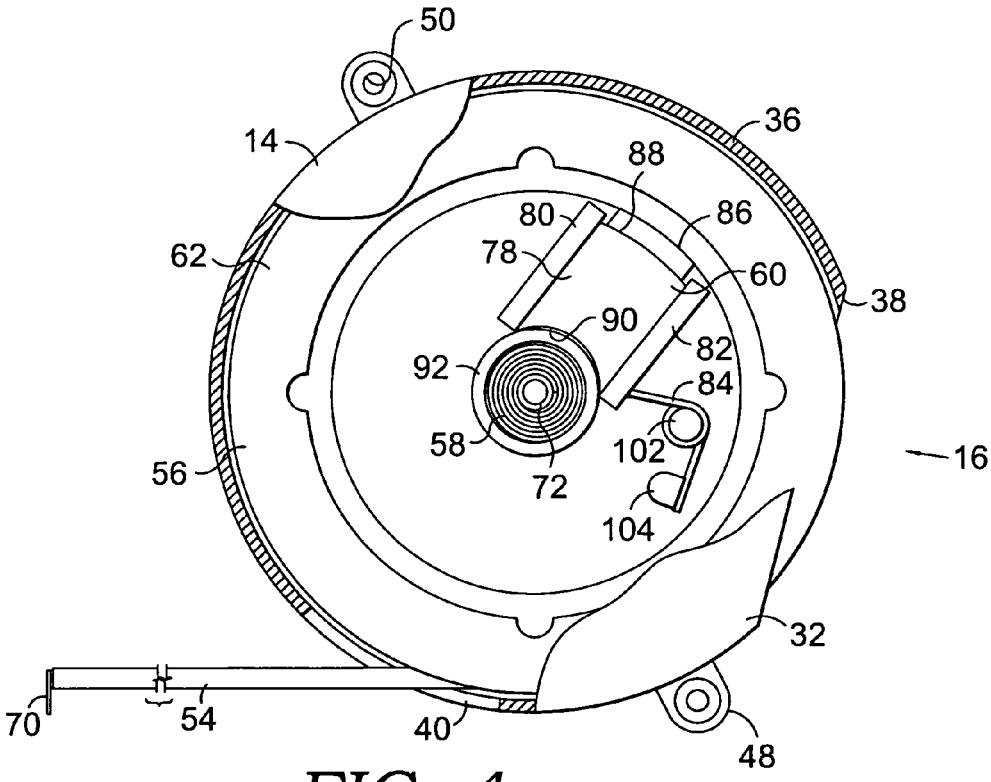
FIG. 4 is a side elevational view of the tape cartridge with a portion thereof cut away to illustrate a reel with a braking mechanism of a first embodiment in a disengaged position in accordance with an embodiment of the present invention.

Referring now to FIGS. 2 and 3, the cartridge or cassette 14 of an embodiment of the present invention is shown. The cartridge 14 generally includes a pair of sidewalls 32, 34 and a cylindrical wall 36, which define a container that houses the tape assembly 16. A first opening 38 in the cylindrical wall 36 allows for a control component, such as the drive 18, to contact the tape assembly 16. When operated, the drive 18 causes the tape assembly to rotate such that the tape 54 extends through a second opening 40 in the cylindrical wall 36. One skilled in the art will recognize that the first opening 38 may be employed in a conventional manual tape measure to allow a stop to extend through the first opening 38 and contact the tape assembly 16.

In an embodiment of the invention shown in FIGS. 2 and 3, one sidewall 32 of the tape cartridge 14 has a portion that extends axially outward, creating a cylindrical space. The cylindrical space is defined by a circular sidewall 42 spaced apart from the sidewall 32 by a side cylindrical wall 44. The cylindrical space allows for the incorporation of a braking mechanism 60 on the tape cartridge as described in further detail below.

The tape cartridge 14 is mounted within the housing 12 using a pair of opposing tabs 46, 48 that extend radially outward from the cylindrical wall 36. The tabs 46, 48 each have an opening 50, 52 through which a fastener 53, such as a screw or bolt, may be passed and attached to the interior of one of the sidewalls 20, 22 of the housing 12. One skilled in the art will recognize that other methods of mounting the tape cartridge within the housing 12 may be employed.

Referring now to FIGS. 4-8, a tape assembly 16 in accordance with an embodiment of the invention is shown. The tape assembly 16 generally includes a tape 54, a reel 56, a pre-tensioned watch spring 58, and a braking mechanism 60. The reel 56 is generally comprised of two opposing annular plates 62, 64 connected by a cylindrical hub 66. A first or proximal end of the tape 54 is connected to the hub 66, and the rest of the tape 54 is coiled around the hub 66. The tape 54 extends first through the second opening 40 in the cartridge 14 and then through a lateral opening 68 in the housing 12 and terminates at a second or distal end with a hook 70.

The pre-tensioned watch spring 58 is connected to the inside of the hub 66 at a first end and connected to a stationary pin 72 at a second end. The stationary pin 72 has a pair of ends that are rigidly connected to the tape cartridge 14 such that it does not rotate during use. The ends may be connected to the cartridge using fasteners or adhesives and may extend through openings 74, 76 in the sidewalls 32, 34 of the tape cartridge 14. When the tape 54 is extended from the housing 12, the reel 56 is rotated against the force of the pre-tensioned watch spring 58 about the pin 72. The force of the pre-tensioned watch spring 58 increases as the tape 54 is extended such that when the tape 54 is released, the force of the pre-tensioned watch spring 58 causes the reel 56 to rotate in the opposite direction and the tape 54 to retract into a fully coiled position.

The braking mechanism 60 of a first embodiment of the invention is illustrated in FIGS. 1 and 4-8. The braking mechanism 60 includes a flyweight 78, a pair of guide rails 80, 82, and a torsion spring 84. A pad 86 is mounted on an outward end 88 of the flyweight 78, while an inward end 90 has an arcuate shape that corresponds with a circular protrusion 92 extending axially outward from a base disc 93.

The bottom surface of the flyweight 78 is preferably maintained in abutting contact with an upper surface of the base disc 93 by the pair of guide rails 80, 82, receiving shoulders 94, 96 that extend from the sides of the flyweight 78. The guide rails 80, 82 extend outwardly from the upper surface of the base disc 93 and have a cantilever portion 98, 100, the bottom surface of which contacts the top surface of the shoulders 94, 96.

The torsion spring 84 is mounted on a cylindrical tab 102 that extends perpendicularly outward from the upper surface of the base disc 93. A first arm 103 of the torsion spring 84 contacts a second tab 104 that extends perpendicularly outward from the upper surface of the base disc 93. A second arm 105 of the torsion spring 84 extends through a hole 106 in the flyweight 78.

The second arm 105 of the torsion spring 84 is biased toward the circular protrusion 92 such that the torsion spring 84 normally maintains the flyweight 78 in a disengaged position, as illustrated in FIGS. 1, 4, 6 and 7. In this disengaged position, the torsion spring 84 causes the inward end 90 of the flyweight 78 to be maintained in contact with the circular protrusion 92, which acts as a rearward stop for the flyweight 78.

Figure 5:
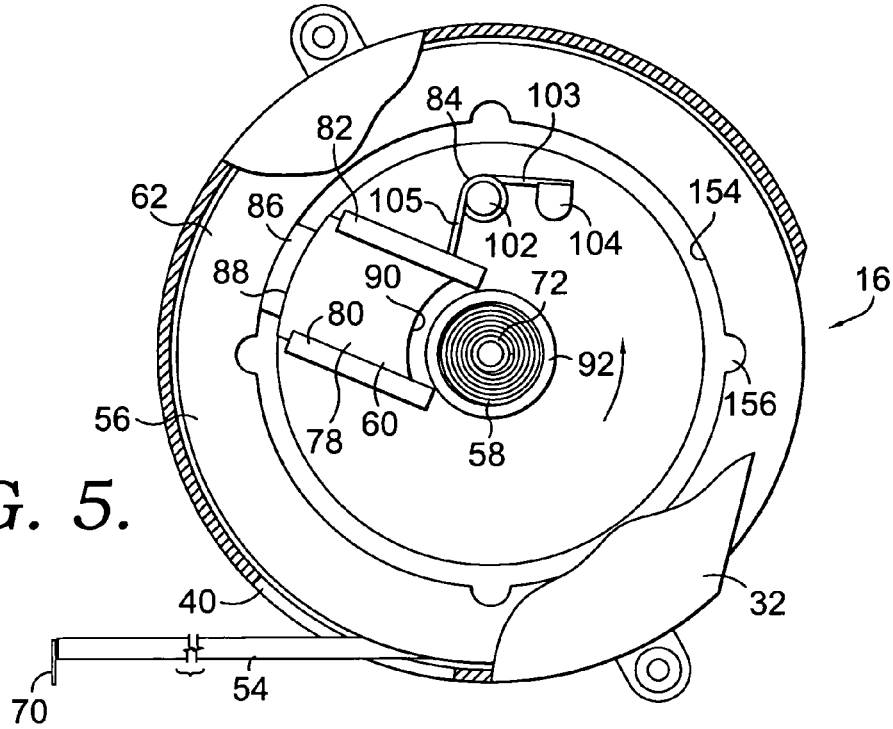
FIG. 5 is a side elevational view of the tape cartridge of FIG. 4 illustrating the braking mechanism in an engaged position in accordance with an embodiment of the present invention.
Figure 6:
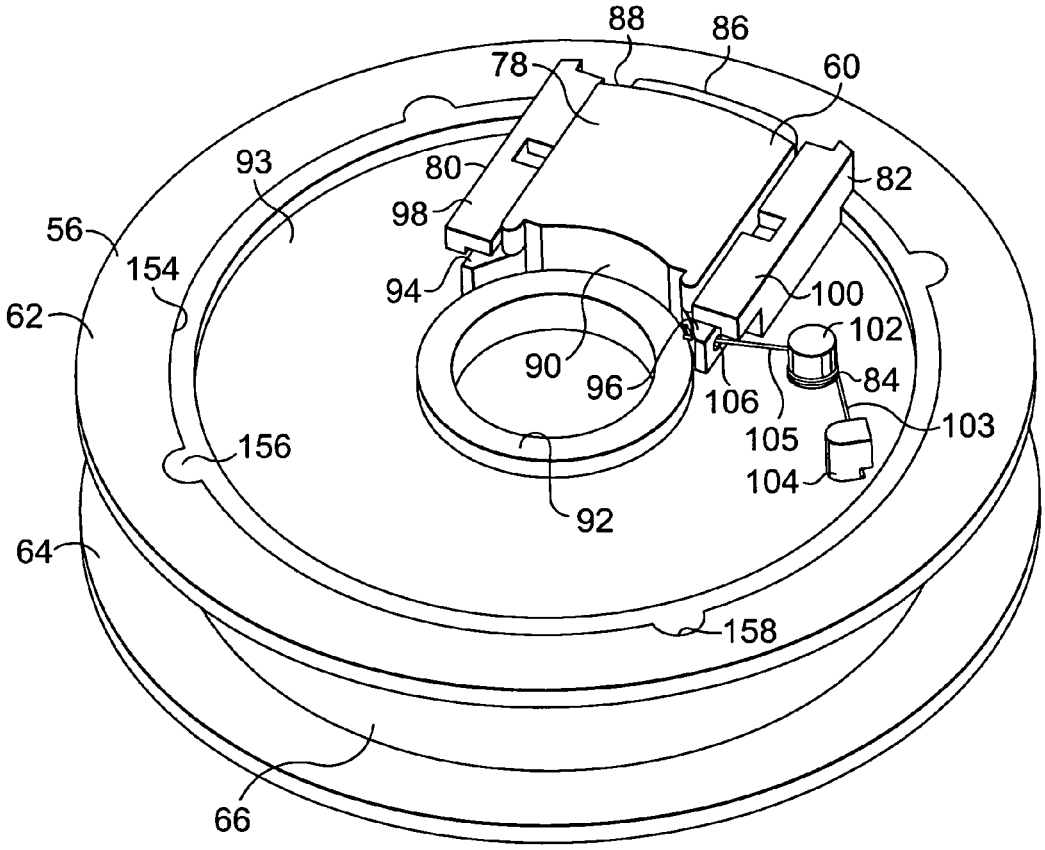
FIG. 6 is a perspective view of the reel and braking mechanism of the first embodiment in accordance with an embodiment of the present invention.
Figure 7:
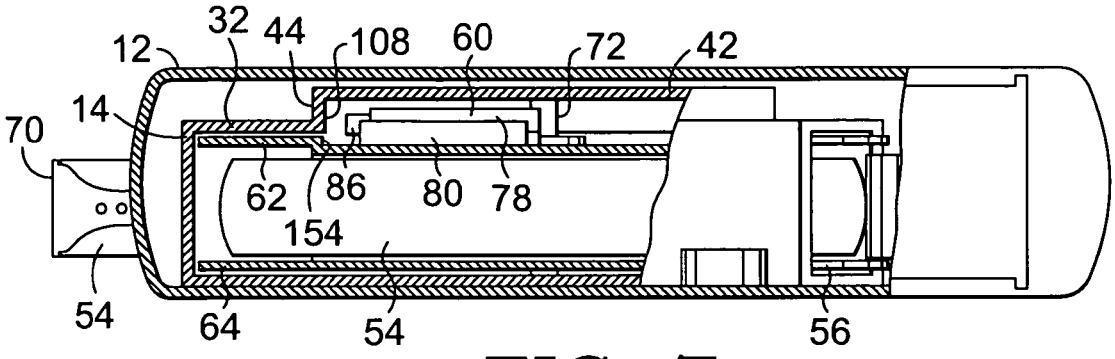
FIG. 7 is a sectional view of the tape measure illustrating the braking mechanism of the first embodiment in the disengaged position with a portion of the tape cartridge cut away in accordance with an embodiment of the present invention.
Figure 8:
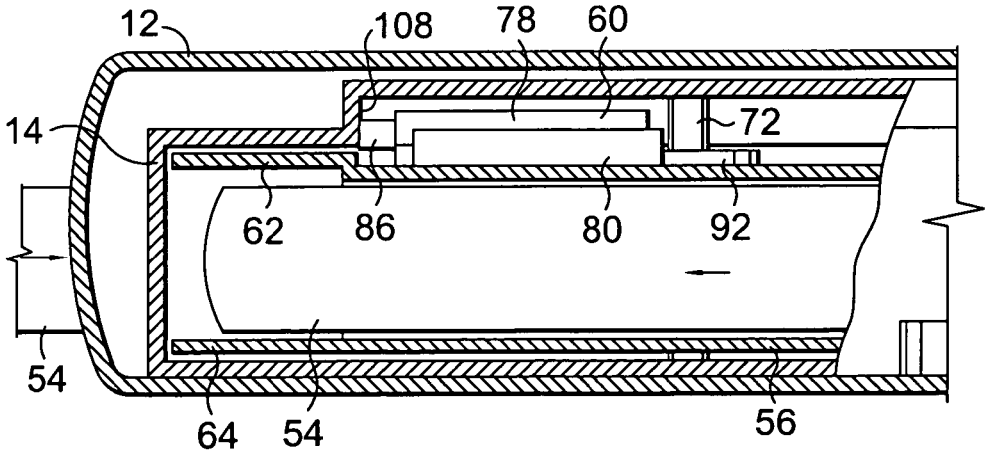
FIG. 8 is an enlarged fragmentary side view of the tape measure of FIG. 7 illustrating the braking mechanism in the engaged position during retraction of the tape as illustrated by the direction and arrows.

When the tape 54 is retracting, the rotation of the reel 56 creates a centrifugal force on the flyweight 78 against the force of the torsion spring 84. As the reel 56 rotates faster, the centrifugal force increases until it overcomes the force of the torsion spring 84 thereby causing the flyweight 78 to move radially outward into an engaged position, wherein the pad 86 of the flyweight 78 contacts a cylindrical surface 108 created by the side cylindrical wall 44 of the tape cartridge 14. The contact between the pad 86 and cylindrical surface 108 causes frictional drag, thereby reducing the speed of rotation of the reel 56. This engaged position for the flyweight 78 is shown in FIGS. 5 and 8.

Referring now to FIGS. 9-12, a second embodiment of the braking mechanism 110 of the present invention is shown. The braking mechanism 110 generally includes a flyweight 112, a pair of guides 114, 116, and a pair of extension springs 118, 120. The flyweight 112 has a generally semicircular shape with an arcuate outer edge 122 and a generally straight inner edge 124. The inner edge 124 has an arcuate notch 125 that corresponds with the circular protrusion 92 extending axially outward from the base disc 93.

Two additional notches 127 extend inward from the inner edge 124 of the flyweight 112 towards the outer edge 122. A center section 129 of each of the notches 127 extends through the flyweight 112, while side sections extend only partially through the flyweight 112 from an upper surface, creating shoulders 126, 128, 130, 132. The t-shaped guide rails 114, 116 engage the shoulders 126, 128, 130, 132 in the notches 127 to maintain the bottom surface of the flyweight 112 in contact with the upper surface of the base disc 93. The guide rails 114, 116 extend radially outward from the upper surface of the base disc 93 and each have a pair of cantilever portions 134, 136, 138, 140, the bottom surface of which contact the top surface of the shoulders 126, 128, 130, 132.

Figure 9:
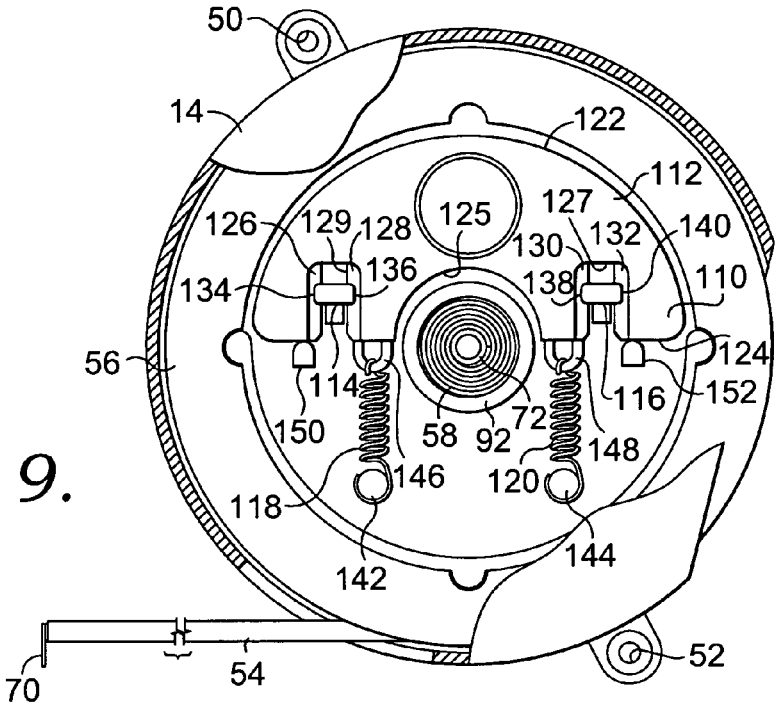
FIG. 9 is a side elevational view of the tape cartridge with a portion cut away to illustrate the reel with a braking mechanism of a second embodiment in a disengaged position in accordance with an embodiment of the present invention.

Each of the pair of extension springs 118, 120 is secured at a first end to one of a pair of cylindrical tabs 142, 144 extending perpendicularly outward from the upper surface of the base disc 93. A second end of each of the extension springs 118, 120 is secured to one of a pair of hooks 146, 148 that extend outwardly from the inner edge 122 of the flyweight 112. The extension springs 118, 120 normally maintain the flyweight 112 in a disengaged position, as shown in FIG. 9. In this disengaged position, the extension springs 118, 120 cause the arcuate notch 125 of the inner edge 122 of the flyweight 112 to be maintained in contact with the circular protrusion 92, which acts as a rearward stop for the flyweight 112. In addition, the inner edge 122 of the flyweight 112 rests against a pair of stops 150, 152 that extend perpendicularly outward from the upper surface of the base disc 93.

Figure 10:
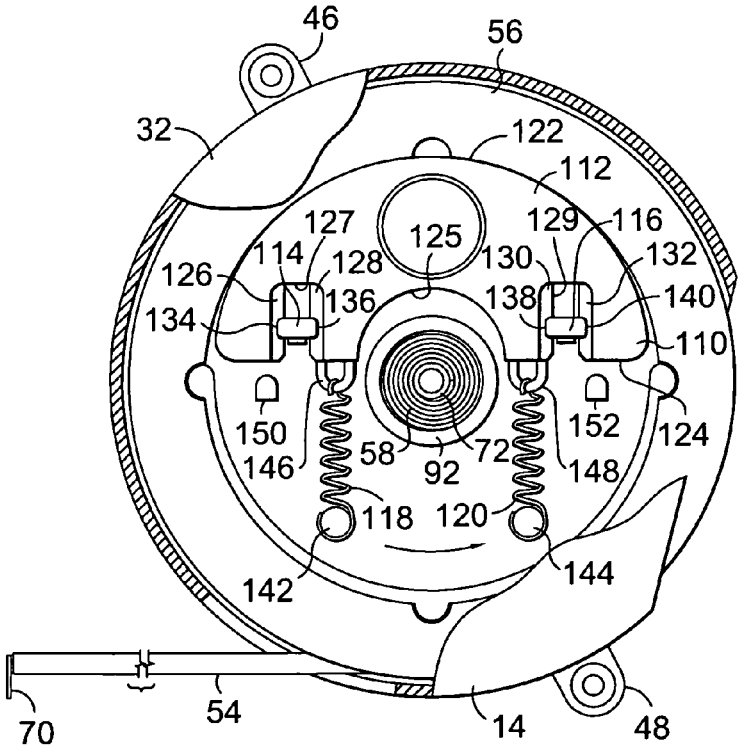
FIG. 10 is a side elevational view of the tape cartridge of FIG. 9 illustrating the braking mechanism in an engaged position in accordance with an embodiment of the present invention.
Figure 11:
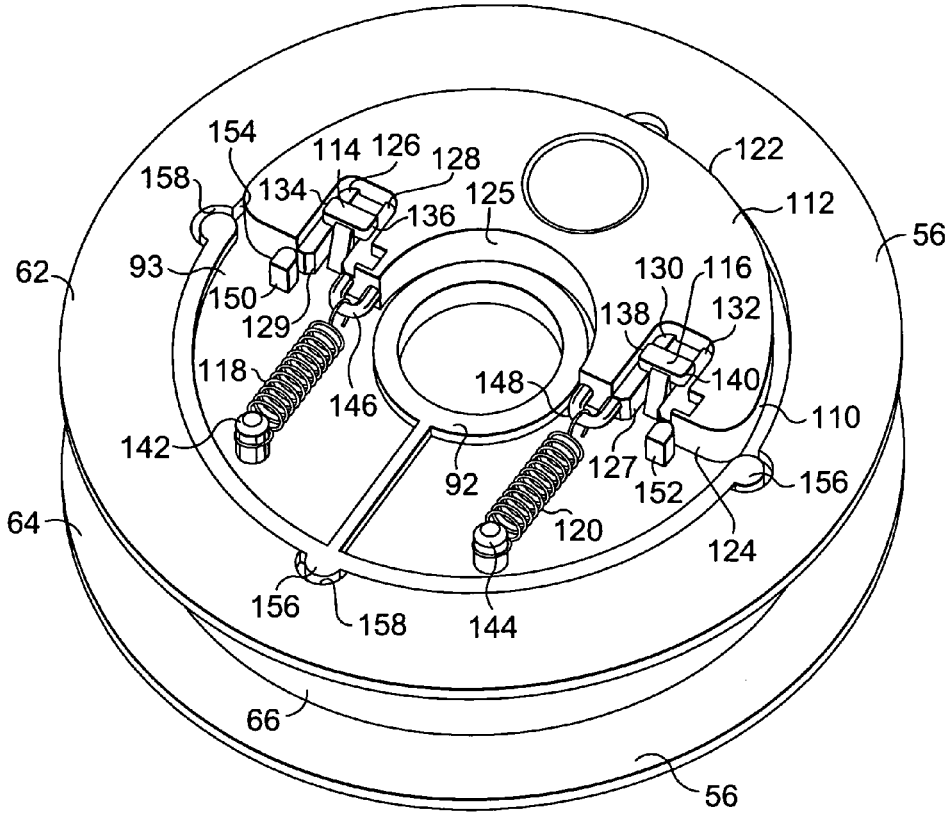
FIG. 11 is a perspective view of the reel and the braking mechanism of the second embodiment in accordance with an embodiment of the present invention.
Figure 12:
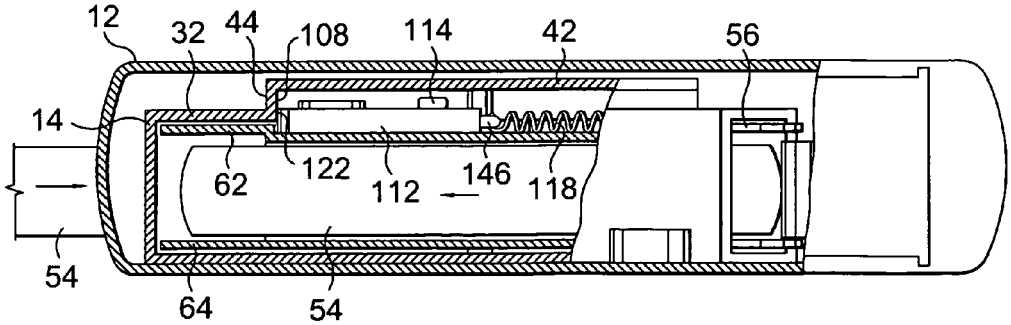
FIG. 12 is a sectional plan view of the tape measure illustrating the braking mechanism of the second embodiment in the engaged position during retraction of the tape as illustrated by the directional arrows.

When the tape 54 is retracting, the rotation of the reel 56 creates a centrifugal force on the flyweight 112 against the force of the extension springs 118, 120. As the speed of rotation of the reel 56 increases, the centrifugal force on the flyweight 112 increased until flyweight 112 moves radially outward to an engaged position in which the arcuate outer edge 122 of the flyweight 112 contacts the cylindrical surface 108 of the tape cartridge 14. The contact between the flyweight 112 and the cylindrical surface 108 causes frictional drag, thereby reducing the speed of rotation of the reel 56. This engaged position for the flyweight 112 is shown in FIGS. 10 and 12.

Although FIGS. 4-12 show embodiments of a tape assembly with a single braking mechanism, one skilled in the art will recognize that embodiments of the present invention may employ multiple braking mechanisms. For example, one embodiment of the invention may employ a first braking mechanism on the outer surface of annular plate 62 and a second braking mechanism on the outer surface of annular plate 64. Another embodiment of the invention may employ two or more braking mechanisms on the same annular plate.

Figure 13:
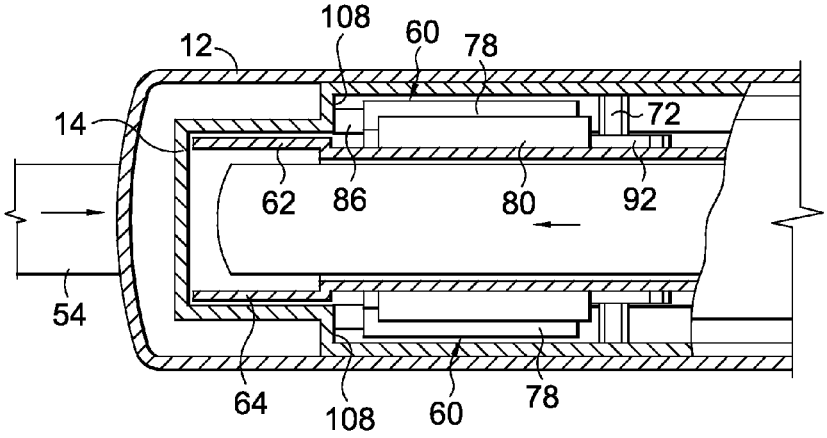
FIG. 13 is a fragmentary, partially sectional, top plan view of an alternate embodiment of the tape measure of FIG. 8 having dual braking mechanisms of the first embodiment on opposite sides of the reel and illustrating the braking mechanisms in the engaged position during retraction of the tape as illustrated by the direction and arrows.
Figure 14:
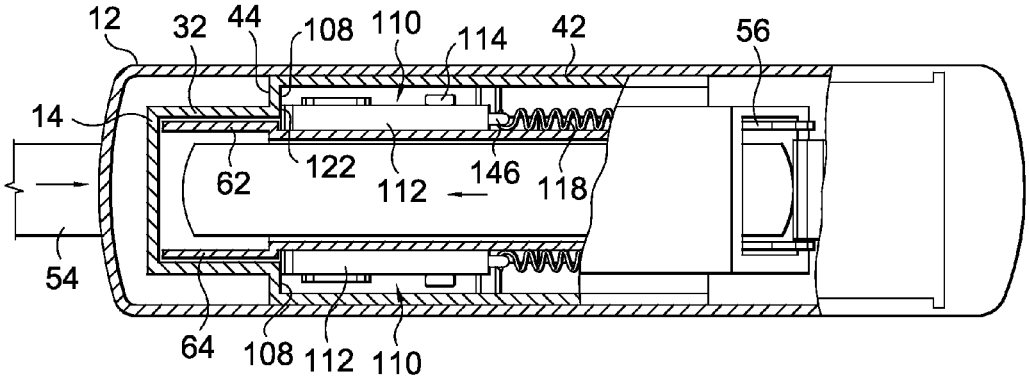
FIG. 14 is a partially sectional, top plan view of an alternate embodiment of the tape measure of FIG. 12 having dual braking mechanisms of the second embodiment on opposite sides of the reel and illustrating the braking mechanisms in the engaged position during retraction of the tape as illustrated by the direction and arrows.

FIGS. 13 and 14 further illustrate embodiments in which a second braking mechanism is employed on the outer surface of the annular plate 64. Referring initially to FIG. 13, an embodiment is illustrated in which a first braking mechanism 60, corresponding with the braking mechanism 60 of FIGS. 4-8, is positioned on the outer surface of annular plate 62, and a second braking mechanism 60 is positioned on the outer surface of annular plate 64. The second braking mechanism 60 is essentially a minor image of the first braking mechanism 60 describe hereinabove, and as such, need not be described in further detail herein. Generally, the second braking mechanism 60 includes a flyweight 78, which may move between a disengaged position, in which the flyweight 78 is not in contact with a second cylindrical surface 108, and an engaged position, in which the flyweight 78 contacts the second cylindrical surface 108.

FIG. 14 illustrates an embodiment in which a first braking mechanism 110, corresponding with the braking mechanism 110 of FIGS. 9-12, is positioned on the outer surface of annular plate 62, and a second braking mechanism 110 is positioned on the outer surface of annular plate 64. The second braking mechanism 110 is essentially a minor image of the first braking mechanism 110 describe hereinabove, and as such, need not be described in further detail herein. Generally, the second braking mechanism 110 includes a flyweight 112, which may move between a disengaged position, in which the flyweight 112 is not in contact with a second cylindrical surface 108, and an engaged position, in which the flyweight 112 contacts the second cylindrical surface 108.

In addition, although the operation of the braking mechanisms was described in the context of contacting a cylindrical surface of the tape cartridge, one skilled in the art will recognize that embodiments of the invention may be employed wherein the tape measure does not include a tape cartridge. In such embodiments, the braking mechanism may function by contacting any fixed surface within the tape measure. For example, in one embodiment, a sidewall of the housing may have a annular cavity creating a fixed cylindrical surface for contacting the braking mechanism.

Further, FIGS. 4-6 and 9-11 illustrate embodiments of the braking mechanism 60, 112 that make use of a base disc 93. The base disc 93 is generally a flat circular disc upon which the remaining components of the braking mechanism 60, 112 are positioned. The base disc 93 is then received in a circular recess 154 in the outer surface of the annular plate 62. In this manner, the braking mechanism 60, 112 can be easily added to or removed from the tape measure 10. This arrangement not only helps with assembly, but it also permits rapid repairs should any components of the braking mechanism fail. To assist with positioning the base disc 93 in the circular recess 154, the outer periphery of the base disc 93 is provided with a plurality of tabs 156 that cooperate with a plurality of corresponding notches 158 positioned around the circular recess 154 in the annular plate 62. The cooperation between the tabs 156 and the notches 158 also works to prevent the braking mechanism 60, 112 from rotating with respect to the reel 56 during use. Alternatively, and as illustrated in FIGS. 1, 7, 8 and 12, a base disc 93 can be omitted and the components of the braking mechanism 60, 112 can be positioned directly on the outer surface of the annular plate 62. In this arrangement, the circular protrusion 92 would extend axially outward from the annual plate 62.

The present invention has been described in relation to particular embodiments, which are intended in all respects to be illustrative rather than restrictive. Alternative embodiments will become apparent to those of ordinary skill in the art to which the present invention pertains without departing from its scope. Substitutions may be made and equivalents employed herein without departing from the scope of the invention as recited in the claims. It will be understood that certain features and subcombinations are of utility and may be employed without reference to other features and subcombinations. This is contemplated and within the scope of the claims.

The invention claimed is:

1. A tape measure having a braking mechanism for providing a controlled tape retraction, the tape measure comprising:

a housing having at least one wall defining a container, the at least one wall having an opening therein;

a tape cartridge enclosed within the housing, the tape cartridge defining a second container and having a pair of sidewalls spaced apart by a cylindrical wall;

a fixed cylindrical surface located in at least one of the sidewalls of the tape cartridge, wherein the fixed cylindrical surface is radially inward of the cylindrical wall;

a reel received in the tape cartridge supported in the housing, the reel having a tape adapted to extend and retract from the opening in the at least one wall of the housing; and at least one braking mechanism coupled with the reel, the at least one braking mechanism including:

a flyweight having a first end and a second end, at least one biasing member connected between the reel and the flyweight, wherein the at least one biasing member allows movement of the flyweight between a first position and a second position, and wherein one of the ends of the flyweight is in contact with the fixed cylindrical surface in one of the first and second positions, and at least one guide, wherein the at least one guide maintains the flyweight in contact with the reel while allowing the flyweight to move between the first position and the second position;

wherein the reel has at least one stop that contacts the first end of the flyweight when the flyweight is in the first position, and wherein the whole flyweight slides radially outward when moving between the first position and the second position.

2. The tape measure of claim 1, wherein the first position is a disengaged position.

3. The tape measure of claim 2, wherein the second end of the flyweight is not in contact with the fixed cylindrical surface when the flyweight is in the disengaged position.

4. The tape measure of claim 1, wherein the second position is an engaged position.

5. The tape measure of claim 4, wherein the second end of the flyweight is in contact with the fixed cylindrical surface when the flyweight is in the engaged position.

6. The tape measure of claim 1, wherein the flyweight is moved from the first position to the second position based on a centrifugal force on the flyweight caused by rotation of the reel.

7. The tape measure of claim 1, wherein the flyweight has a pad located on the second end.

8. The tape measure of claim 1, wherein the at least one biasing member is a torsion spring.

9. The tape measure of claim 1, wherein the at least one biasing member is an extension spring.

10. The tape measure of claim 1, further comprising a second fixed cylindrical surface located in the cartridge.

11. The tape measure of claim 10, further comprising at least one second braking mechanism located on the reel, the at least one second braking mechanism including:

a second flyweight having a first end and a second end, at least one second biasing member connected between the reel and the second flyweight, wherein the at least one second biasing member allows movement of the second flyweight between a disengaged position, in which the second end of the second flyweight is not in contact with the second fixed cylindrical surface, and an engaged position, in which the second end of the second flyweight is in contact with the second fixed cylindrical surface, and wherein the second flyweight moves from the disengaged position to the engaged position based on a centrifugal force on the second flyweight caused by rotation of the reel, and at least one second guide, wherein the at least one second guide maintains the second flyweight in contact with the reel while allowing the second flyweight to move between the disengaged position and the engaged position.

12. The tape measure of claim 1, wherein the reel is enclosed within the tape cartridge, wherein the at least one of the sidewalls of the tape cartridge has a portion that extends axially outwardly thereby defining a cylindrical space with a circular sidewall, wherein the fixed cylindrical surface is located in the at least one of the sidewalls of the tape cartridge on an interior of the circular sidewall of the cylindrical space.

13. The tape measure of claim 1, wherein the sidewalls of the tape cartridge are circular and wherein the sidewalls and the cylindrical wall cooperate to define the second container into which the reel is received.

14. The tape measure of claim 13, wherein one of the pair of circular sidewalls has a portion that extends axially outwardly to define a cylindrical space and wherein the fixed cylindrical surface is located in the cylindrical space.

15. The tape measure of claim 13, wherein the cartridge is formed as two pieces which mate in clam shell fashion to enclose the reel.

16. A tape measure having a braking mechanism for providing a controlled tape retraction, the tape measure comprising:

a housing having at least one wall defining a container, the at least one wall having an opening therein;

a fixed cylindrical surface located in the housing;

a reel supported in the housing, the reel having a tape adapted to extend and retract from the opening in the at least one wall of the housing; and at least one braking mechanism coupled with the reel, the at least one braking mechanism including:

a flyweight having a first end and a second end, wherein the flyweight includes a first receiving shoulder extending from a first side of the flyweight and a second receiving shoulder extending from a second side of the flyweight, at least one biasing member connected between the reel and the flyweight, wherein the at least one biasing member allows movement of the flyweight between a first position and a second position, wherein one of the ends of the flyweight is in contact with the fixed cylindrical surface in one of the first and second positions, and wherein the at least one biasing member includes a spring contacting both the flyweight and the reel, and at least one guide, wherein the at least one guide maintains the flyweight in contact with the reel while allowing the flyweight to move between the first position and the second position, and wherein the at least one guide comprises a pair of guide rails, each guide rail extending outwardly from an outward surface of the reel and having a cantilever portion, wherein a bottom surface of the cantilever portion faces a top surface of one of the first and second receiving shoulders, wherein the whole flyweight slides radially outward when moving between the first position and the second position.

17. The tape measure of claim 16, wherein the first position is a disengaged position.

18. The tape measure of claim 17, wherein the second end of the flyweight is not in contact with the fixed cylindrical surface when the flyweight is in the disengaged position.

19. The tape measure of claim 16, wherein the second position is an engaged position.

20. The tape measure of claim 19, wherein the second end of the flyweight is in contact with the fixed cylindrical surface when the flyweight is in the engaged position.

21. The tape measure of claim 16, wherein the flyweight is moved from the first position to the second position based on a centrifugal force on the flyweight caused by rotation of the reel.

22. The tape measure of claim 16, wherein the flyweight has a pad located on the second end.

23. The tape measure of claim 16, wherein the fixed cylindrical surface extends from the at least one wall of the housing.

24. The tape measure of claim 16, further comprising a second fixed cylindrical surface located in the housing.

25. The tape measure of claim 24, wherein the second fixed cylindrical surface extends from the at least one wall of the housing.

26. The tape measure of claim 24, further comprising at least one second braking mechanism located on the reel, the at least one second braking mechanism including:

a second flyweight having a first end and a second end, at least one second biasing member connected between the reel and the second flyweight, wherein the at least one second biasing member allows movement of the second flyweight between a disengaged position, in which the second end of the second flyweight is not in contact with the second fixed cylindrical surface, and an engaged position, in which the second end of the second flyweight is in contact with the second fixed cylindrical surface, and wherein the second flyweight moves from the disengaged position to the engaged position based on a centrifugal force on the second flyweight caused by rotation of the reel, and at least one second guide, wherein the at least one second guide maintains the second flyweight in contact with the reel while allowing the second flyweight to move between the disengaged position and the engaged position.

27. The tape measure of claim 16, wherein the at least one biasing member includes a torsion spring mounted on a first tab extending perpendicularly outward from the outward surface of the reel, wherein a first arm of the torsion spring contacts a second tab extending perpendicularly outward from the outward surface of the reel, and wherein a second arm of the torsion spring extends into a hole in the flyweight.

28. A tape measure having a braking mechanism for providing a controlled tape retraction, the tape measure comprising:

a housing having at least one wall defining a container, the at least one wall having an opening therein;

a fixed cylindrical surface located in the housing;

a reel supported in the housing, the reel having a tape adapted to extend and retract from the opening in the at least one wall of the housing; and at least one braking mechanism coupled with the reel, the at least one braking mechanism including:

a base disc upon which components of the braking mechanism are positioned, the base disc being coupled with the reel, a flyweight movably coupled with the base disc, the flyweight having a first end and a second end, wherein the flyweight includes a first receiving shoulder extending from a first side of the flyweight and a second receiving shoulder extending from a second side of the flyweight, at least one biasing member connected between the base disc and the flyweight, wherein the at least one biasing member allows movement of the flyweight between a first position and a second position, wherein one of the ends of the flyweight is in contact with the fixed cylindrical surface in one of the first and second positions, and wherein the at least one biasing member includes a spring contacting both the flyweight and the base disc, and at least one guide, wherein the at least one guide maintains the flyweight in contact with the base disc while allowing the flyweight to move between the first position and the second position, and wherein the at least one guide comprises a pair of guide rails, each guide rail extending outwardly from an outward surface of the base disc and having a cantilever portion, wherein a bottom surface of the cantilever portion faces a top surface of one of the first and second receiving shoulders, wherein the whole flyweight slides radially outward when moving between the first position and the second position.

* * * * *